US005664682A

United States Patent [19]

Eren

[11] Patent Number: 5,664,682

[45] Date of Patent: Sep. 9, 1997

[54] DISPLAY DEVICE

[75] Inventor: Mustafa Eren, Istanbul, Turkey

[73] Assignee: Timur Schindel, Turkey

[21] Appl. No.: 724,496

[22] Filed: Sep. 30, 1996

Related U.S. Application Data

[63] Continuation-in-part of Ser. No. 568,250, Dec. 6, 1995, Pat. No. 5,560,492.

[51] Int. Cl.[6] ..... B65D 75/00

[52] U.S. Cl. ..... 206/756; 206/779

[58] Field of Search ..... 206/736, 756, 206/757, 762, 763, 764, 766, 745, 746, 747, 775, 779

[56] References Cited

U.S. PATENT DOCUMENTS

| | | | |
|---|---|---|---|
| 350,479 | 9/1886 | Levezey | D9/415 |
| 1,599,492 | 9/1926 | Rothschild | 206/762 |
| 1,713,758 | 5/1929 | Horwath . | |
| 2,302,919 | 2/1942 | Snider . | |
| 3,002,608 | 10/1961 | Zwickey | 206/763 |
| 3,050,183 | 11/1962 | Mueller . | |
| 3,139,255 | 6/1964 | Palm . | |
| 3,376,975 | 4/1968 | Brothers . | |
| 3,532,310 | 10/1970 | Finfrock | 248/46 |
| 3,847,282 | 11/1974 | Collura et al. | 206/491 |
| 4,503,975 | 3/1985 | Meyers et al. | 206/486 |
| 5,560,492 | 10/1996 | Eren | 206/779 X |

*Primary Examiner*—Jacob K. Ackun

*Attorney, Agent, or Firm*—St. Onge Steward Johnston & Reens

[57] ABSTRACT

A display device formed of a sheet of flexible material which may be attached to a base and has a lower portion shaped into a lower tab and has a cut to form a support flap in an upper portion with at least one cut in the support flap sized to receive and retain edges of the lower tab when the lower portion is bent upwards to overlap the support flap. The lower portion of the strip is attached to the support flap by inserting the lower tab into either a slit in the support flap or interlocking with edges of a cut out in the flap. Upon bending of the strip, the space vacated by the support flap forms a window in which an article for display can be inserted. In another embodiment a complex shape is achieved by interengaging a multiple of tabs with cuts in a flexible strip to hold elongate articles with aligned apertures in the display.

9 Claims, 6 Drawing Sheets

90
92
94.1
94.2
94.3
94.4
96.1
96.2
98.1
98.2
100
102
104
106
108
97
15

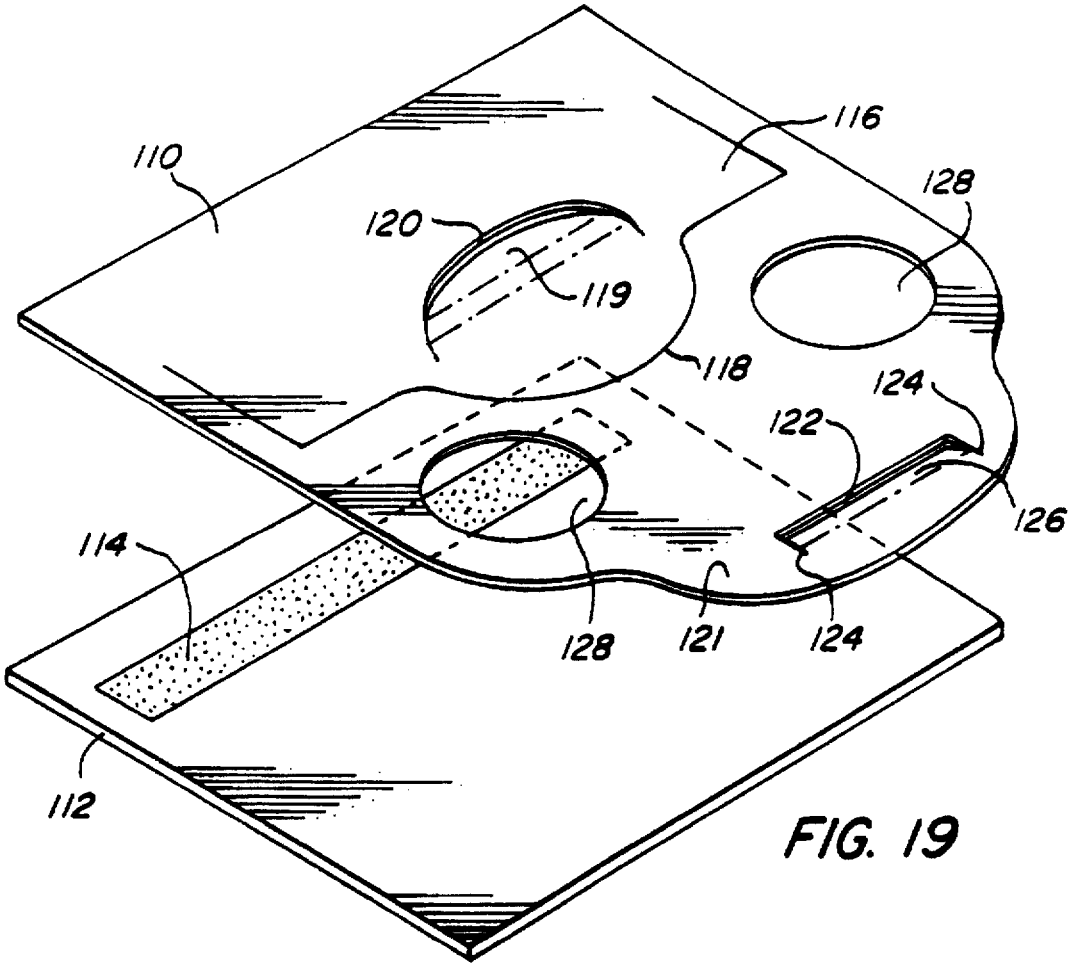
FIG. 19
FIG. 21
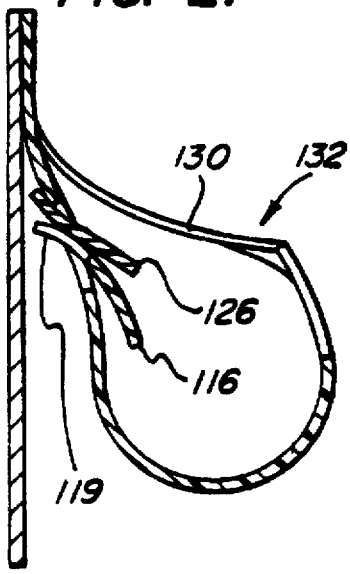
FIG. 20
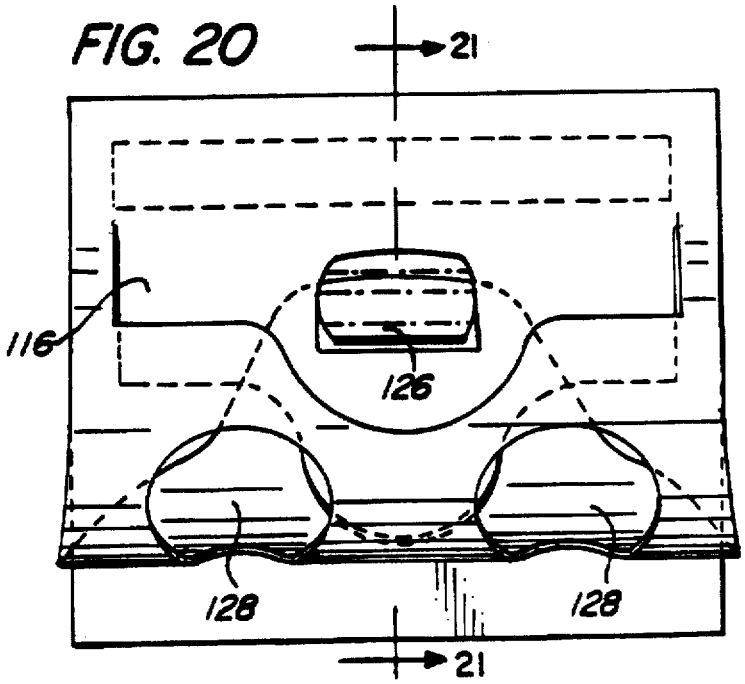

DISPLAY DEVICE

PRIOR APPLICATIONS

This application is a continuation-in-part of U.S. patent application entitled Display Device bearing Ser. No. 568,250 filed on Dec. 6, 1995 by the same inventor as for this application and owned by the same Assignee and which will issue as U.S. Pat. No. 5,560,492 on Tuesday Oct. 1, 1996.

FIELD OF THE INVENTION

This invention relates to display devices and, in particular to point-of-purchase displays.

BACKGROUND OF THE INVENTION

Article displays, such as point-of-purchase displays, are commonly used today. These displays may be for single or multiple items and may support the articles in a number of ways. A common method to display and support articles is with the use of a hook which is inserted into a hole in the packaging of the article. Typically the packaging is cardboard or plastic and is displayed in such a manner so that it can be conveniently taken from the display by the purchaser.

An example of display packaging which is intended to be taken along with the product is U.S. Pat. No. 4,503,975 to Meyers which discloses a display package for an article such as a bottle of nail polish. The Meyers display device is formed by punching, folding and gluing a section of cardboard around the article. This type of display device is effective, however, it does not allow the item to be removed from the support, thus it is not reusable. Also, the packaging must be glued together which requires drying time and also requires pre-assembly at a site other than the one where the packaging is to be used.

Another method for displaying and supporting articles is to provide a reusable display device which allows the article to be removed when selected while leaving the display intact. An example of such a display device is U.S. Pat. No. 3,376,975 to Brothers which discloses a stamped, folded and glued section of cardboard in which single articles may be displayed and which includes a hole for a hook support. Since articles may be removed from the Brothers display device, it is an effective reusable display device. However, as with the Meyers device, the Brothers' display also requires gluing and pre-assembly.

What is desired, therefore, is a display device which is reusable, which requires a minimum amount of pre-assembly work and which may be assembled quickly and which may be assembled and disassembled many times.

SUMMARY OF THE INVENTION

It is an object of the invention to provide a reusable display device which requires a minimum amount of pre-assembly and which may be quickly assembled at the point of display.

Another object of the invention is to provide a display device which may be assembled and disassembled many times.

Another object of the invention is to provide a display device which may be shipped in a flat configuration and assembled at the point of display without the use of adhesives.

Still another object of the invention is to provide a display device which does not require any creasing during assembly.

Yet another object of the invention is to provide a display device which is formed from a single strip of flexible material attached to a support.

In accordance with one form of the display device of the present invention, a sheet of flexible material is attached by the back of its top portion to a base or other suitable support. A cut, which can be in a middle portion of the strip, is shaped so as to form a support flap, which remains hingedly connected to the strip. A second cut, in the support flap, forms a retaining tab which is so shaped and oriented as to enable it to engage a slit in a lower portion of the strip when it is bent underneath and upwards. When the tab engages the slit the flap captures and retains the lower strip portion and the space in the strip vacated by the flap forms an opening leading into a receptacle in which an article for display can be inserted while being seated on the backside of the upwardly bent lower portion of the strip.

In accordance with another form of a display device of the present invention, a sheet of flexible material is attached by the back to a base or other suitable support. A cut, which can be in a middle portion of the strip, is shaped so as to form a support flap, which remains hingedly connected to the strip. A second cut in the support flap is so shaped and oriented as to enable it to receive a tab in a lower portion of the strip when the lower portion is bent upwards so that the lower portion and the flap partially overlap. When the tab engages the slit the flap captures and retains the lower strip portion and the space in the strip vacated by the flap forms an opening leading into a receptacle in which an article for display can be inserted while being seated on the backside of the upwardly bent lower portion of the strip.

In still another display in accordance with the invention a strip of flexible bendable material is provided with a plurality of cuts. Several of the cuts define tabs and these together with other cuts are spatially arranged so that with a bending of one end of the strip in a first direction a tab interengages and interlocks with one cut and with a bending of the strip in another direction another tab engages and locks with another cut so as to form an S shaped display for holding elongate articles through openings made in the strip material.

With a display device in accordance with the invention a flat sheet of material can be conveniently altered into a display device. The sheet need only be die cut with appropriate slits and cuts and can be shipped in flat form to the place of use. Erection of the display device from the sheet form is readily accomplished. A plurality of receptacles on a single sheet can be formed.

The invention and its particular features and advantages will become more apparent from the following detailed description considered with reference to the accompanying drawings.

BRIEF DESCRIPTION OF THE DRAWINGS

FIG. 19 is a an exploded, perspective view of still another display device of the present invention showing the optional step of adhering the top portion of the flexible strip to the base and showing the strip in a flat configuration;

FIG. 20 is a perspective view of the display device of FIG. 18 showing the step of bending the lower portion of the strip to overlap the support flap formed in the strip.

FIG. 21 is a side view of the display device of FIG. 19 showing the lower portion of the strip attached to the support flap.

DETAILED DESCRIPTION OF THE INVENTION

Figure 1:
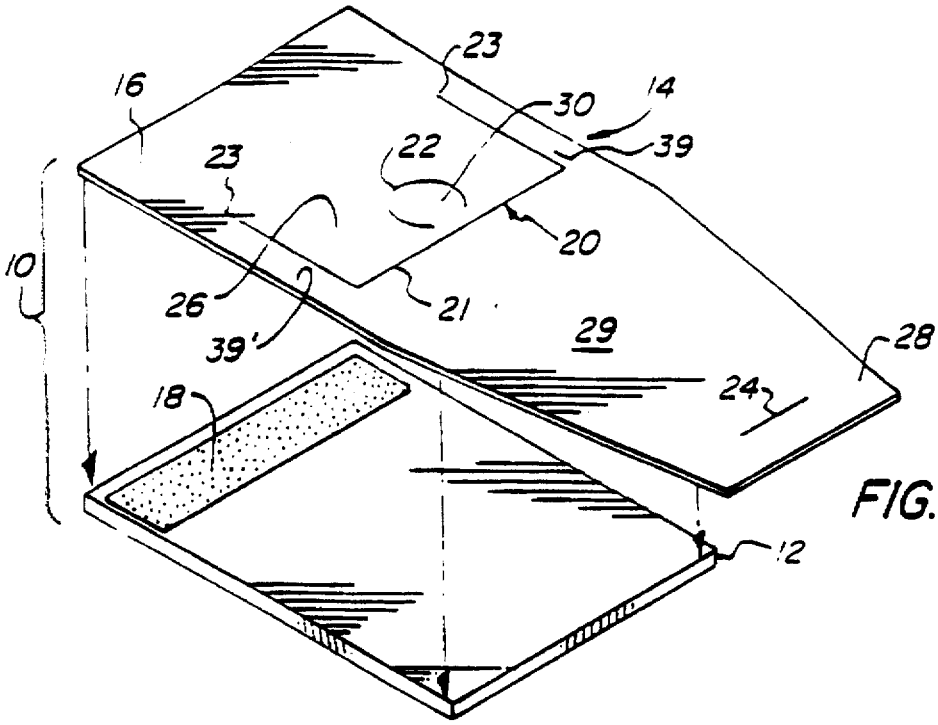
FIG. 1 is a an exploded, perspective view of a display device of the present invention showing the optional step of adhering the top portion of the flexible strip to the base and showing the strip in a flat configuration.

Referring to FIGS. 1 through 4, a display device 10 consists of a base 12 and a strip of flexible material 14. The strip can be transformed into a display by bending it so that a lower portion 28 can be retained by an inwardly bent flap 26 to form a receptacle 15 in which an article such as 17 can be placed for display through an opening 37 formed by the bent flap 26.

The back of the strip 14 may be attached by a top portion 16 thereof to a base 10 by an adhesive 18. This adhesive 18 is optional and, if used, is preferably the only adhesive employed in the invention.

Strip 14 includes a number of cuts 20, 22 and a slit 24 therethrough. Cut 20 forms a support flap 26 for supporting a lower portion 28 of strip 14 and forming an opening 37 leading into the. Cut 22 and slit 24 form a retaining tab 30 and a retaining slit 32, respectively, for attaching the lower portion 28 of strip 14 to support flap 26. Since the strip 14 is flexible, the retaining tab 30 is hingedly connected to the strip 14 and may be bent away from the strip 14 for insertion into the retaining slit 32.

Preferably, the shape of cut 20 is rectangular, however, other shapes are within the present invention. It is important however, that there is some part such as 21 of cut 20 which is closer to lower portion 28 of strip 14 than the endpoints 23 of cut 20. Preferably, the shape of cut 22, which forms the retaining tab 30, is substantially semi-circular, however, other shapes for tab 30 are within the scope of the invention.

Preferably, cut 22 is located within support flap 26 and the matching slit 24 is located on the lower portion 28 of strip 14. However, the placement of cut 22 and slit 24 could be reversed. In case of such reversal the orientation of the retaining tab 30 is also reversed so that the tendency of the lower portion 28 to withdraw from attachment to flap 26 is properly restrained. Moreover, other means of attaching lower portion 28 to support flap 26, such as by use of adhesives or other attachment devices, such as staples and the like, are within the present invention.

The middle and lower portions 28, 29 of strip 14 are shown with tapered sides 31-31' though this shaping of the sides is not necessary. Strip 14 can be made of a strong, bendable, and some what stiff but resilient, clear thermoplastic material, though other bendable materials can be used and the material need not be transparent and could be translucent or opaque. The base can be made of any suitable material such as wood or cardboard or plastic.

Figure 2:
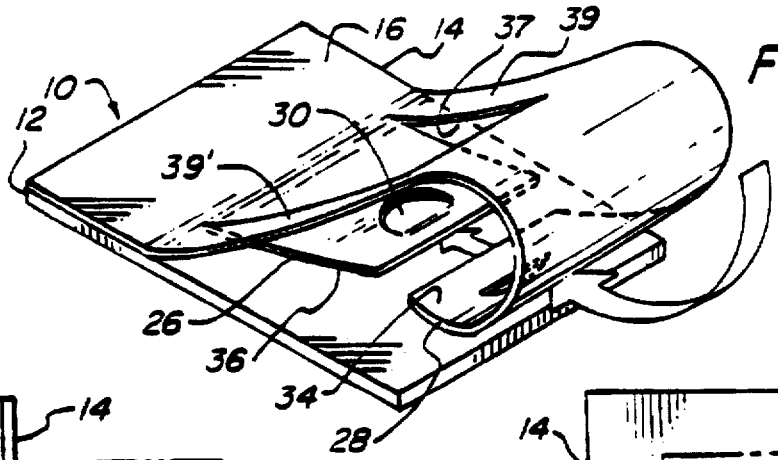
FIG. 2 is a perspective view of the display device of FIG. 1 showing the step of bending the lower portion of the strip underneath and toward the support flap formed in the strip.

Referring to FIGS. 1 and 2, to form display device 10, the back of the top portion 16 of the strip 14 may be attached to the base 12. This can be done with an adhesive or such other suitable fastening material. Next, the lower portion 28 is folded underneath itself toward the support flap 26 and the retaining tab 30 inserted through the slit 24. Preferably, the lower portion 28 is positioned between the support flap 26 and the base 12 such that the back surface 34 of the lower portion 28 is in contact with the back surface 36 of the support flap 26. This ensures that articles being inserted into the display will not snag on the edge 36 of the lower portion 28 or on the retaining tab 30.

Figure 3:
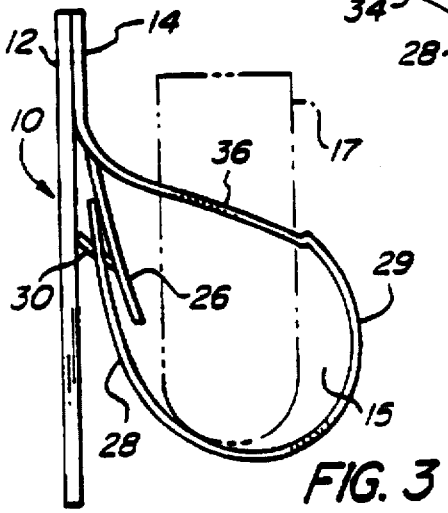
FIG. 3 is a side view of the display device of FIG. 2 showing the lower portion of the strip attached to the support flap and showing an article inserted through the window formed in the strip.
Figure 4:
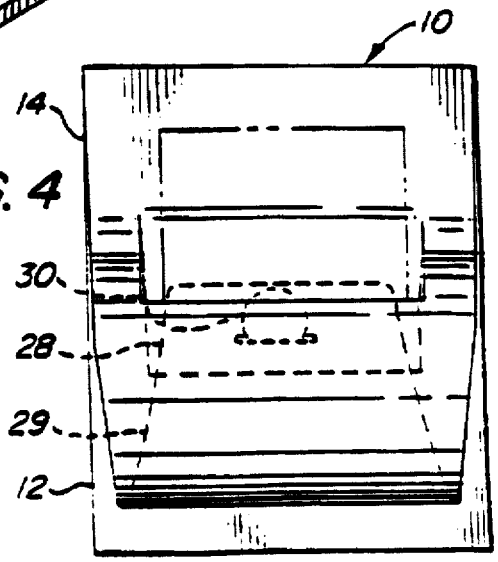
FIG. 4 is a front view of the display device of FIG. 3.

Referring to FIGS. 2, 3 and 4 when the strip 14 is bent and retaining tab 30 and retaining slit 24 are interengaged by inserting the retaining tab 30 through the retaining slit 24, the support flap 26 is hinged away from strip 14 and is positioned relatively close to the base 12. The space vacated by the bent flap 26 forms a window 37 through which one can insert display articles such as 17 which seat on the back side of the upwardly bent lower portion 28 of strip 14.

Side portions 39—39' of the strip 14 along the support flap 26, after bending of the lower portion 28 and bending of flap 26, extend outwardly to provide side supports for an article 17. A loop is formed by the middle portion 29 of the strip 14 as it extends outwardly and below the opening 37 to form front and bottom walls for the receptacle 15 while the lower portion 28 of strip 14 forms a back wall.

Figure 5:
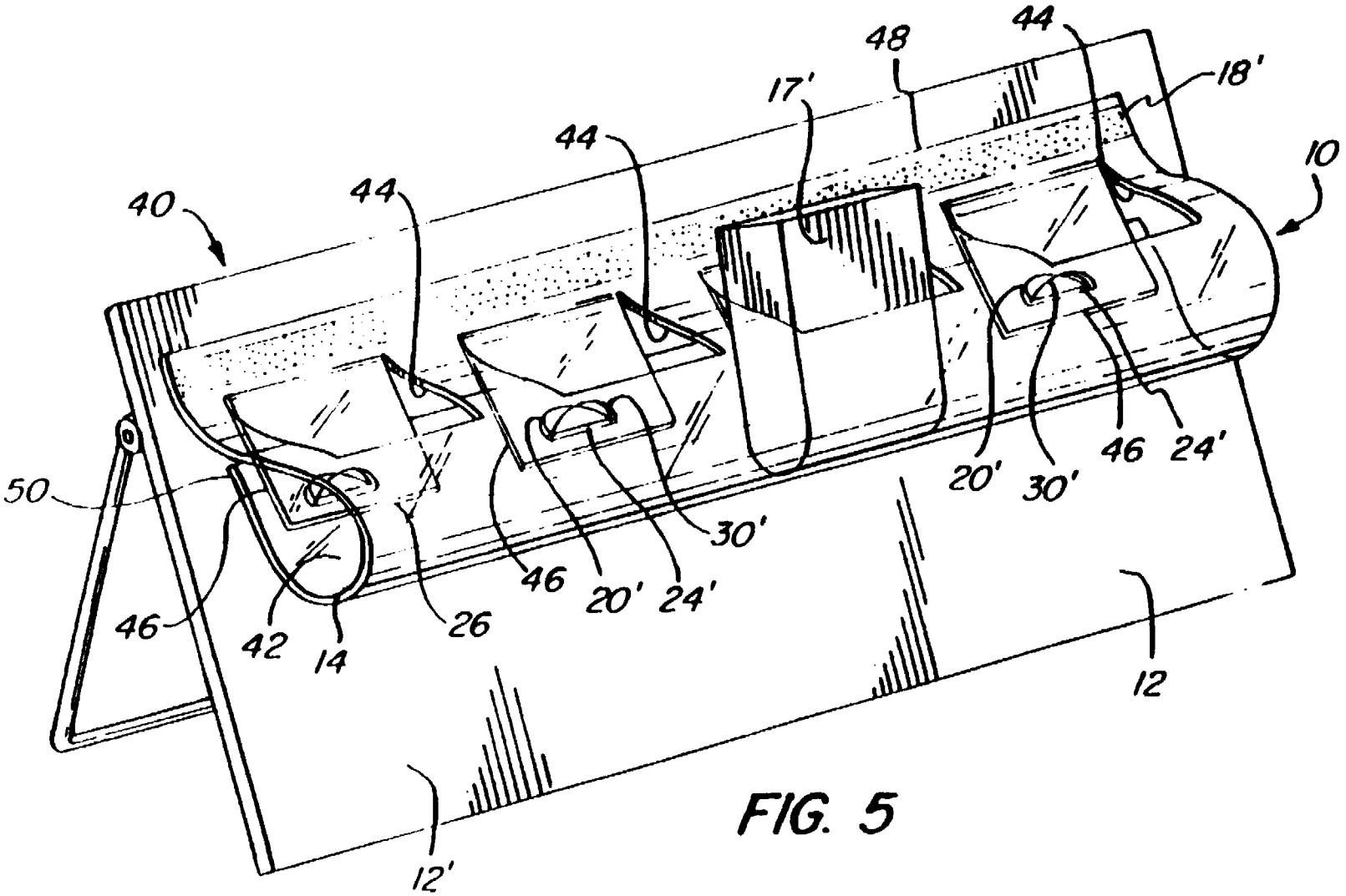
FIG. 5 is an isometric view of the present invention showing a single transparent strip forming multiple display bins.

Referring to FIG. 5, a display device 40 is shown to form a single receptacle 42 with a plurality of spaced apart receptacle windows 44 formed by spaces vacated by inwardly bent support flaps 46. The flaps 46 like those shown in FIGS. 1–4 are hingedly connected. The display device 40 is formed of a single transparent strip 48 including a plurality of cuts 20' to form tabs 30' and slits 24' for enabling support flaps 46 to be attached to the lower portion 50 of strip 48. Preferably, the lower portion 50 of the strip 48 is attached to each support flap 46 to provide a strong support for an article such as 17', however lower portion 50 need not be attached to each support flap 46. The display device 40 may be attached to a base 12' by an adhesive 18' on the top portion thereof.

Referring to FIGS. 6 through 9, a display device 60 consists of a base 12' and a strip of flexible material 14'. As explained in the aforementioned copending patent application the strip 14' can be transformed into a display by bending it so that a lower portion 28' at least partially overlaps and thus can be retained by an inwardly bent flap 26'. This results in a receptacle 15' in which an article can be placed for display through an opening 37' vacated by the bent flap 26'.

The backside of the strip 14' may be attached by a top portion 1'6 thereof to base 12' by an adhesive 18' or other suitable attachment device or material. This adhesive 18' is optional and, if used, is preferably the only adhesive employed in the invention.

Figure 7:
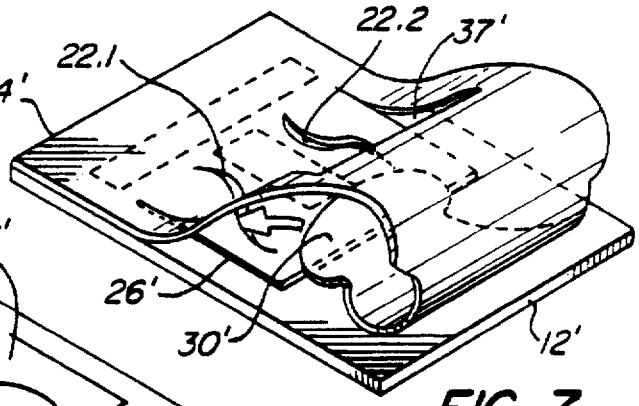
FIG. 7 is a perspective view of the display device of FIG. 6 showing the step of bending the lower portion of the strip to overlap the support flap formed in the strip.
Figure 6:
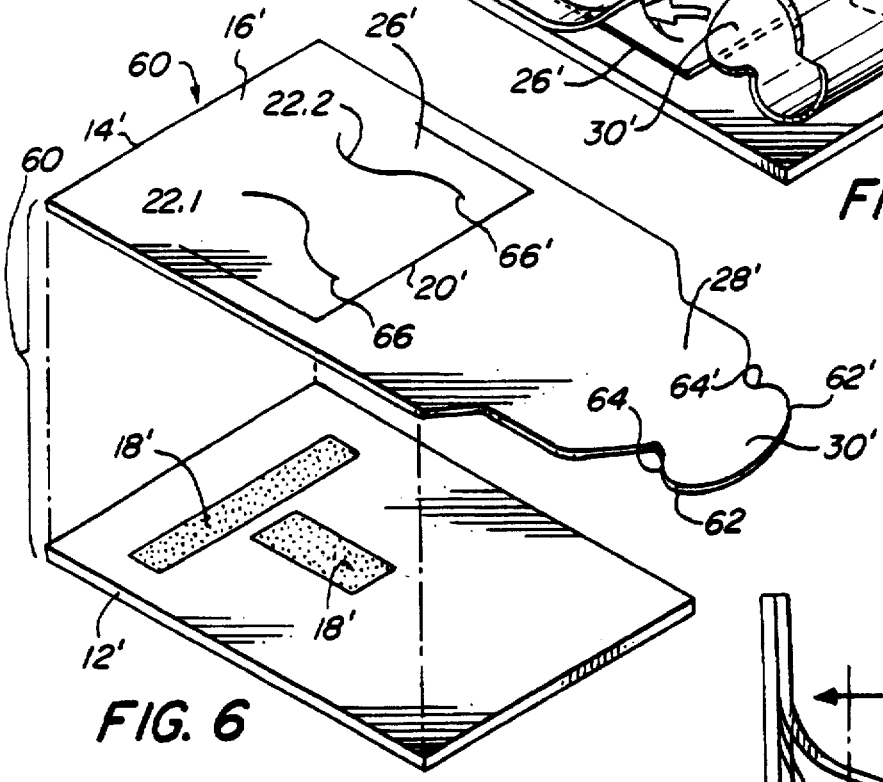
FIG. 6 is a an exploded, perspective view of a display device of the present invention showing the optional step of adhering the top portion of the flexible strip to the base and showing the strip in a flat configuration.
Figure 8:
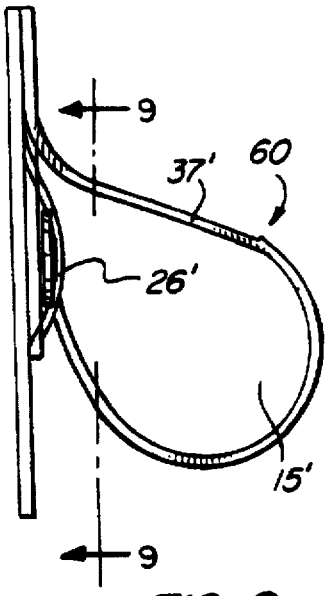
FIG. 8 is a side view of the display device of FIG. 7 showing the lower portion of the strip attached to the support flap.
Figure 9:
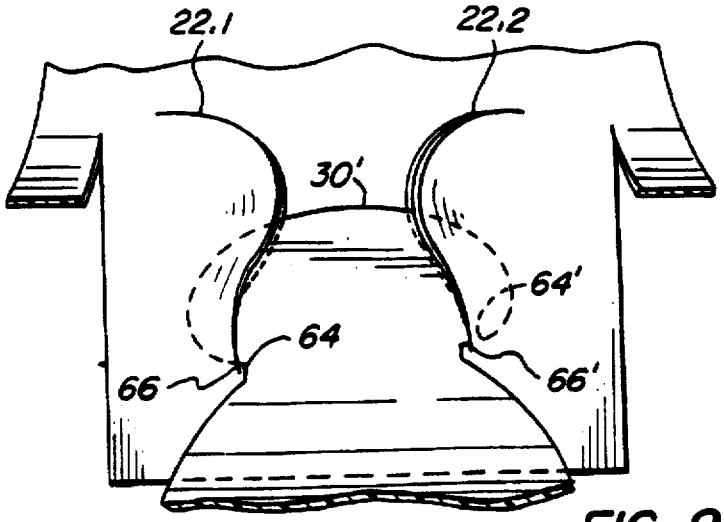
FIG. 9 is a plan view of the portion of the display illustrated in FIG. 8 and taken along the line 9—9 therein.
Figure 11:
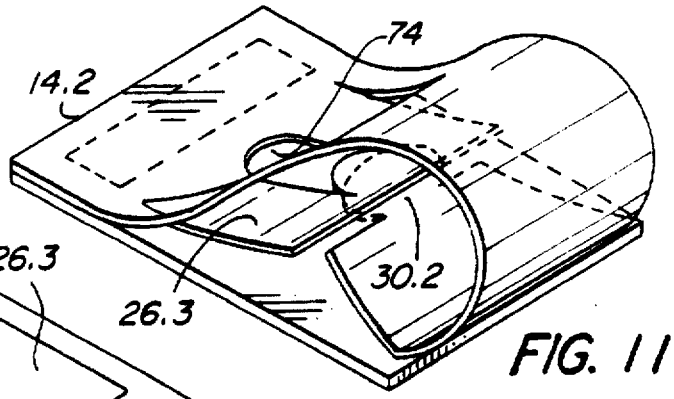
FIG. 11 is a perspective view of the display device of FIG. 10 showing the step of bending the lower portion of the strip to overlap the support flap formed in the strip.

Strip 14' includes a number of cuts 20', 22.1 and 22.2. Cut 20' forms support flap 26' for supporting lower portion 28' of strip 14' and when bent out of its planar position forms an opening 37' leading into receptacle 15'. The lower end 28' is a retaining tab 30' for attachment through retaining cuts 22.1, 22.2 to support flap 26'. The tab 30' is preferably so shaped that it has at least one laterally extending edge 62 with a retaining edge 64, that, when there are two, 64—64', can be seated on to the bottom ends 66 of retaining cut 22.1 and 22.2. By providing a pair of laterally extending edges 62, 62' a symmetrical retention of the tab 30' and thus the lower portion 28' is obtained as is illustrated in the views of FIGS. 7 and 9. Note that tab 30' can overlap support flap 26' by either fitting over or under it when engaging the retaining cuts 22.1 and 22.2.

Figure 10:
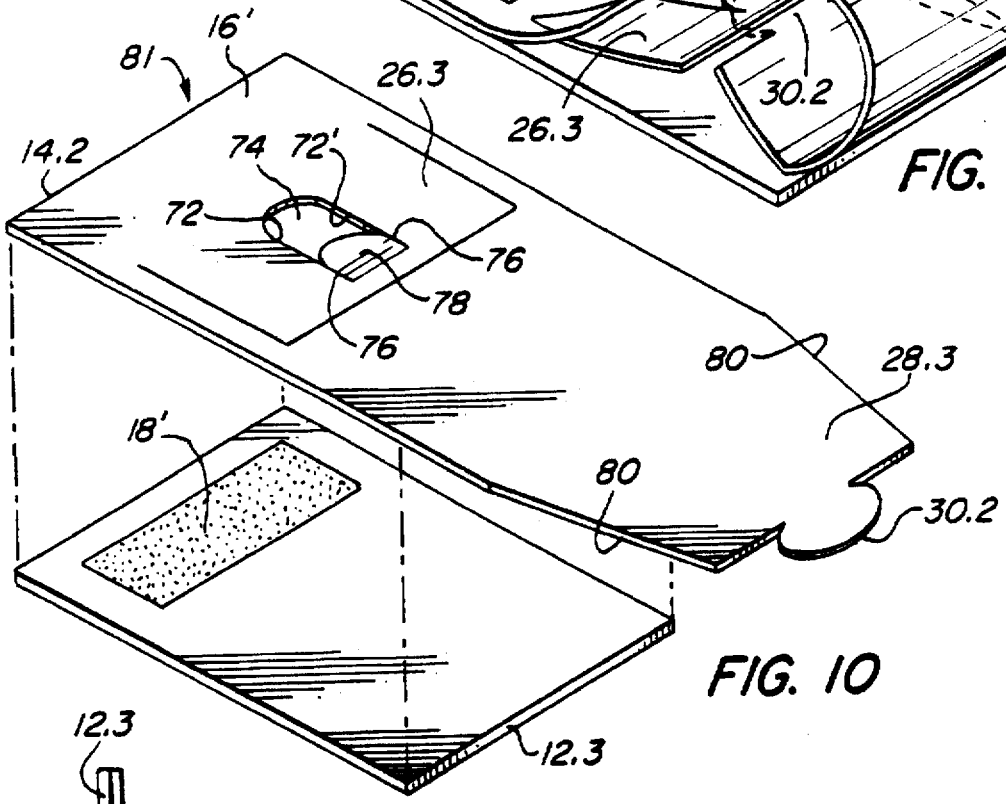
FIG. 10 is a an exploded, perspective view of another display device of the present invention showing the optional step of adhering the top portion of the flexible strip to the base and showing the strip in a flat configuration.
Figure 12:
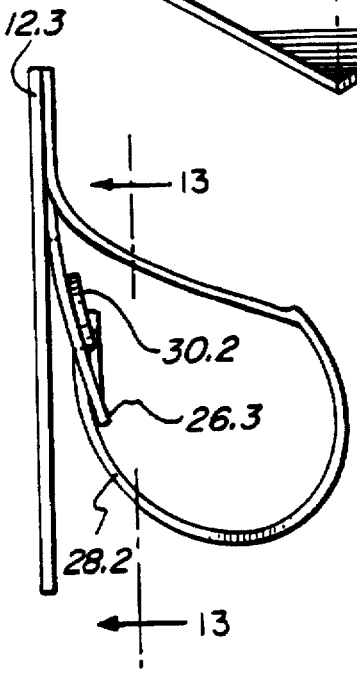
FIG. 12 is a side view of the display device of FIG. 11 showing the lower portion of the strip attached to the support flap.
Figure 13:
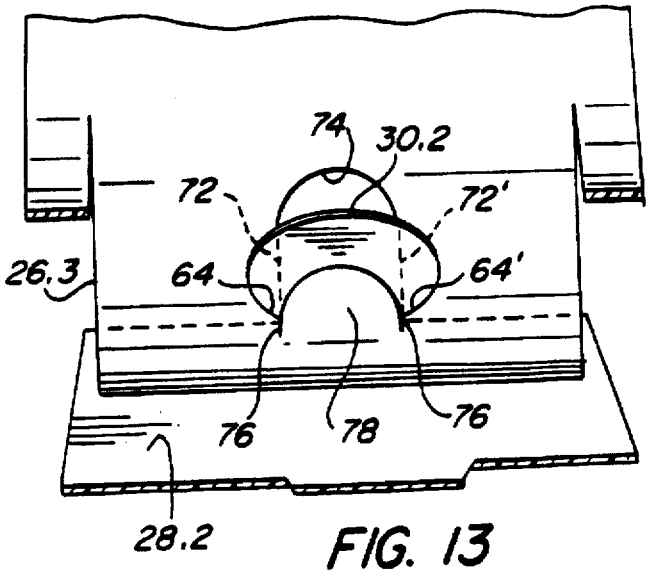
FIG. 13 is a plan view of the portion of the display illustrated in FIG. 12 and taken along the line 13—13 therein.

The shapes of retaining cuts 22.1,22.2 can be either S curved as illustrated in the embodiment of FIGS. 6–9 or straight such as the sides 72, 72' of a cut out 74 as shown in FIG. 10. The term "cut" as used herein, therefore, includes slits and cut outs and side edges 72, and 72' of a cut out 74 and various shapes are contemplated by the invention. The side edges 72, 72' of cut out 74 in the embodiment of FIG. 10 terminate with slits 76 with a tab 78 between them. This enables retaining edges 64, 64' of the tab 30.2 on the lower portion 28.2 of strip 14' to make a firm interlocking engagement with the support flap 26' as illustrated in FIG. 13.

With reference to FIGS. 14–18 still another embodiment of the invention is illustrated and which can be bent into a more complex shape. A strip of flexible sheet material 90 such as used with the embodiment of FIG. 1 is affixed to a base 92 with a suitable adhesive. The strip has a plurality of cuts 94.1, 94.2 94.3 and 94.4. The cuts 94.3 and 94.4 are shaped to define retaining tabs 96.1 and 96.2. A row 98.1 of cut outs 100 are located between cuts 94.2 and 94.3 and laterally spread across the strip 90. Another row 98.2 of entry cut outs 102 are located between cuts 94.3 and 94.4 and are spread out evenly across the strip 90 in lateral alignment with cut outs 100.

Figures 14, 15, 16, 17, 18:
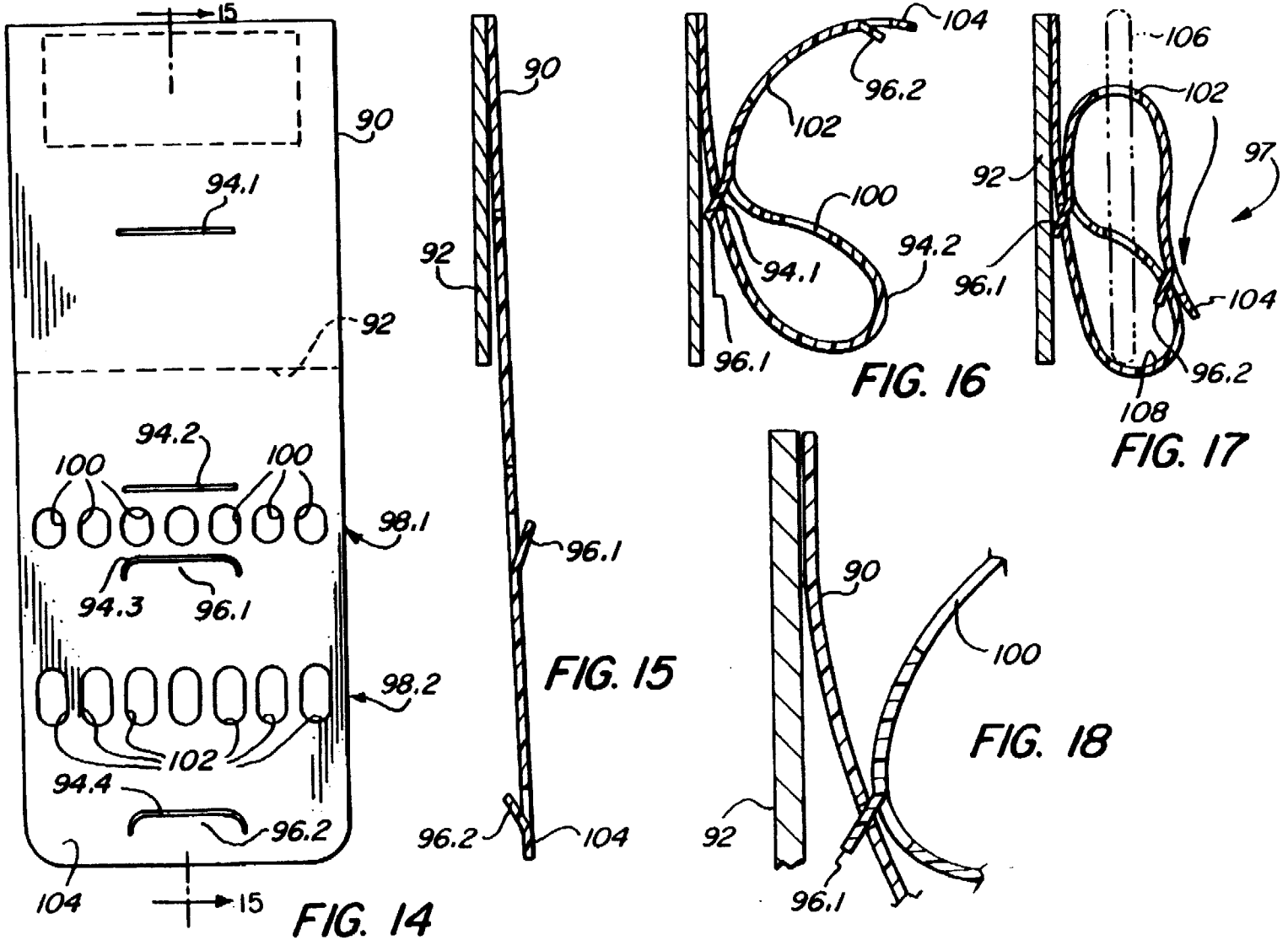
FIG. 14 is a front unfolded view of another display device in accordance with the invention.
FIG. 15 is a section view of the display device illustrated in FIG. 14 and is taken along the line 15—15 in FIG. 14.
FIG. 16 is a similar section view of the display device as FIG. 15 during a folding step in the formation of the display.
FIG. 17 is a similar section view of the display device as FIG. 15 during a second final folding step in the formation of the display.
FIG. 18 is an enlarged side view of a portion of the view in FIG. 16.

The retaining tabs 96.1 and 96.2 can be bent out of the plane of the strip sheet material 90 as illustrated in FIG. 15. Tab 96.1 is bent out in one direction and tab 96.2 in an opposite direction. The end 104 of strip 90 is then bent around counter clockwise until tab 96.1 engages cut 94.1 to be retained by it as illustrated in FIGS. 16 and 18.

The end 104 is then bent clockwise as shown in FIG. 16 until the tab 96.2 engages cut 94.2 as shown in FIG. 17 to form a display 97. The cuts 94 are so located that the cut outs 100 become aligned with the cut outs 102 but at different vertical locations. This enables the folded display to retain various sized elongate articles such as 106. The articles are entered through cut outs 102 and 100 to seat onto the surface 108 of strip 90. The sizes and shapes of cut outs 100 and 102 and the cuts 94 and tabs 96 can be varied in accordance with the present invention to fit all sorts of different articles such as pens, pencils, lipsticks and the like. Display 97 can be held vertically as shown in FIG. 17 or used at such other angles as appears desirable.

In the embodiment according to FIGS. 19–21 a strip of sheet material 110 is applied to a base 112 with a suitable adhesive 114. The strip has a support flap 116 formed with a cut 118, which defines a tab 119 and the flap includes a curved cut out 120 as illustrated in FIG. 19. The bottom portion 121 of strip 110 is in the shape of a tab with a smaller lateral width than the support flap 116 and has a cut out 122. Cut out 122 has side edges 124 which extend towards the lower end of said strip so as to form a tab 126 between them. A pair of round openings 128 are made between the support flap cut 118 and cut out 122.

When the bottom end is bent around so that the tabs 119 and 126 interengage and interlock the openings 128 are aligned beneath the opening 130 vacated by the bent support flap 116. In this manner unusually long articles can be supported by the display 132 formed with strip 110.

Although the invention has been described with reference to a particular arrangement of parts, features and the like, these are not intended to exhaust all possible arrangements or features, and indeed many other modifications and variations will be ascertainable to those skilled led in the art.

What is claimed is:

1. A display device for removable articles comprising:

a generally flat strip of flexible and bendable sheet material having an upper portion containing a first cut sized and shaped to define a support flap hinged to the upper portion, said strip having a lower portion;

said support flap being provided with at least one second cut; said lower portion of said strip being shaped to form a lower tab shaped and sized to at least partially fit through the second cut and be retained by the support flap when the support flap is hinged away from said strip to leave a receptacle opening and the lower portion of the strip is bent around to at least partially overlap said hinged support flap to interengage with the second cut and transform the lower portion of the strip into a receptacle of said display device having said opening through which an article can be inserted.

2. The display device as in claim 1 wherein said support flap has a second cut to receive and interengage with said retaining tab.

3. The display device as in claim 1 wherein said second cut in said support flap comprises a cut out having opposed side edges, with said second cut sized to enable said lower tab to overlap the cut out when bent to form said receptacle.

4. The display device as in claim 3 wherein said cut out has side edges which extend in the form of slits past the cut out towards the lower tab so as to form a second tab between them and enable said lower tab to interlock with said slits.

5. The display device as in claim 1 wherein said support flap has a pair of spaced apart cuts and wherein said lower tab is shaped to have side edges oriented to interengage with side edges of said cuts in said support flap.

6. The display device as in claim 4 wherein said lower portion of the strip has a second cut out with side edges which extend towards an end of said strip to form second slits that define said lower tab between them; said lower tab being sized to slidingly fit into the cut out in said support flap when said lower portion is bent upwards to overlap said support flap.

7. A display device for removable articles comprising:

a generally flat strip of flexible, bendable, material having a plurality of spaced apart cuts in vertical alignment with each other; a pair of said cuts being shaped to form first and second tabs, with a first aperture located between a first tab and an adjacent cut and a second aperture located between the first and second tabs;

said cuts being so spaced from each other that, when one end of said strip is bent in one direction and the first tab interlocks with a first cut and upon bending of the strip's one end in another direction enables the second tab to interlock with a second cut, said first and second apertures are in alignment with each other to form a receptacle and enable an article to be inserted through them into the receptacle.

8. The display as claimed in claim 7 wherein a first row of apertures is located between the first tab and said first cut and a second row of apertures is located between the first and second tabs, with said apertures being laterally aligned with each other.

9. The display as claimed in claim 7 wherein said strip material is formed of a transparent thermoplastic material.

* * * * *